US010166463B1

(12) United States Patent
Gustafson et al.

(10) Patent No.: US 10,166,463 B1
(45) Date of Patent: Jan. 1, 2019

(54) PIE GAME AND METHOD FOR PLAYING THE SAME

(71) Applicants: Kurtis Lee Gustafson, Westerville, OH (US); Norah Lee Gustafson, Westerville, OH (US)

(72) Inventors: Kurtis Lee Gustafson, Westerville, OH (US); Norah Lee Gustafson, Westerville, OH (US)

( * ) Notice: Subject to any disclaimer, the term of this patent is extended or adjusted under 35 U.S.C. 154(b) by 0 days.

(21) Appl. No.: 15/234,161

(22) Filed: Aug. 11, 2016

Related U.S. Application Data

(60) Provisional application No. 62/204,398, filed on Aug. 12, 2015.

(51) Int. Cl.

| | |
|---|---|
| ***A63F 3/00*** | (2006.01) |
| ***A63F 9/00*** | (2006.01) |
| ***A63F 9/04*** | (2006.01) |
| ***A63F 11/00*** | (2006.01) |

(52) U.S. Cl.
CPC ..... *A63F 9/0073* (2013.01); *A63F 9/04* (2013.01); *A63F 11/0074* (2013.01); *A63F 2011/0016* (2013.01)

(58) Field of Classification Search
CPC ..... A63F 9/0073; A63F 9/04; A63F 11/0074; A63F 2011/0016
USPC ..... 273/243, 287, 290
See application file for complete search history.

(56) References Cited

U.S. PATENT DOCUMENTS 1,359,646 A 11/1920 Zion
2,253,787 A 8/1941 Kelly
3,468,540 A * 9/1969 Mulligan ..... A63F 3/001 273/141 R
3,647,218 A 3/1972 Foley et al.
3,817,531 A * 6/1974 King ..... A63F 3/00006 273/157 R
3,909,003 A 9/1975 Rabinovich
4,948,146 A * 8/1990 Snyder ..... A63F 3/0478 273/157 R (Continued)

OTHER PUBLICATIONS

Eeboo Make a Pie Game, Bumblebee Toys Website, Web page <http://bumblebeetoys.com:80/learn/learning-toys/make-a-pie.html#.WjHL_z90wdU>, 2 pages, dated Nov. 25, 2012, retrieved from Internet Archive Wayback Machine <https://web.archive.org/web/20121125025044/http://bumblebeetoys.com:80/learn/learning-toys/make-a-pie.html#.WjHL_z90wdU> on Dec. 13, 2017.

*Primary Examiner* — Vishu Mendiratta
(74) *Attorney, Agent, or Firm* — The Law Office of Patrick F. O'Reilly III, LLC

(57) ABSTRACT

A pie game of chance and strategy is disclosed herein. The pie game includes a plurality of sector-shaped game pieces with favorable and unfavorable pie indicia printed thereon; a plurality of pans configured to be distributed to players of the pie game, each of the plurality of pans configured to hold a portion of the plurality of sector-shaped game pieces therein such that, when the pan is circumferentially filled with the portion of the plurality of sector-shaped game pieces, a complete circular pie is formed in the pan; and at least one die, the at least one die configured to determine an action taken by one or more of the players of the pie game when the at least one die is rolled by one of the players. A method for playing a pie game of chance and strategy is also disclosed herein.

8 Claims, 10 Drawing Sheets

(56) References Cited

U.S. PATENT DOCUMENTS

| | | | | |
|---|---|---|---|---|
| 5,037,110 | A * | 8/1991 | Haskel | A63F 1/00 273/157 A |
| 5,062,637 | A | 11/1991 | Bianchi | |
| 5,149,098 | A | 9/1992 | Bianchi | |
| 5,788,238 | A | 8/1998 | LeBriton et al. | |
| 6,193,234 | B1 | 2/2001 | Jones | |
| 6,193,235 | B1 | 2/2001 | Vancura et al. | |
| 6,315,292 | B1 * | 11/2001 | Howlett | A63F 3/0494 273/236 |
| 7,017,908 | B1 | 3/2006 | Tan et al. | |
| 2004/0075214 | A1 | 4/2004 | Roberts | |

* cited by examiner

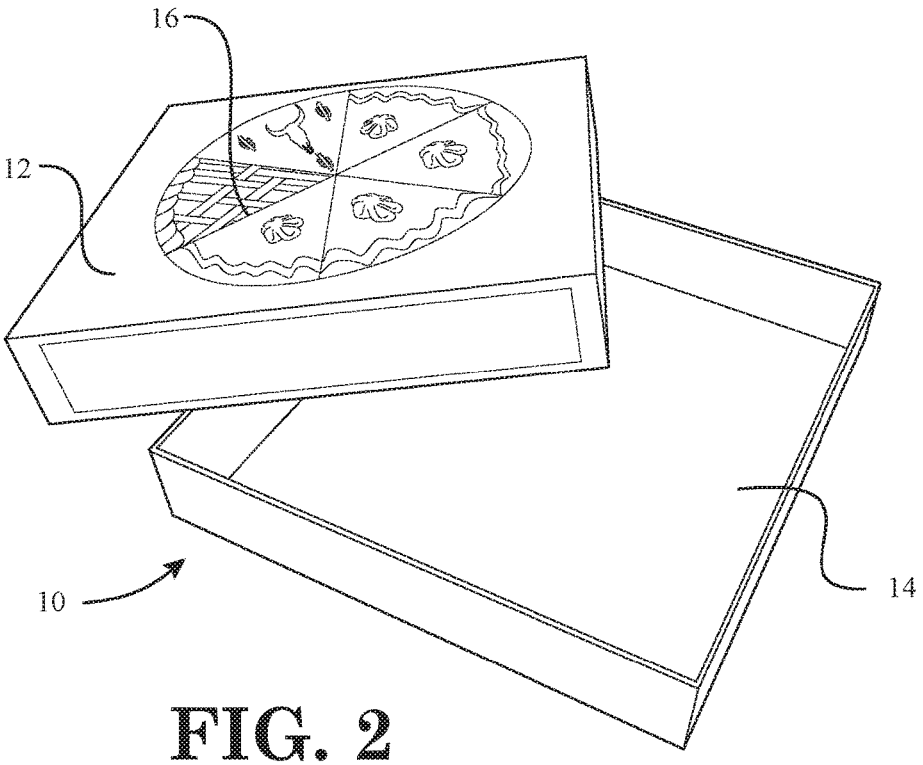
FIG. 2
FIG. 3
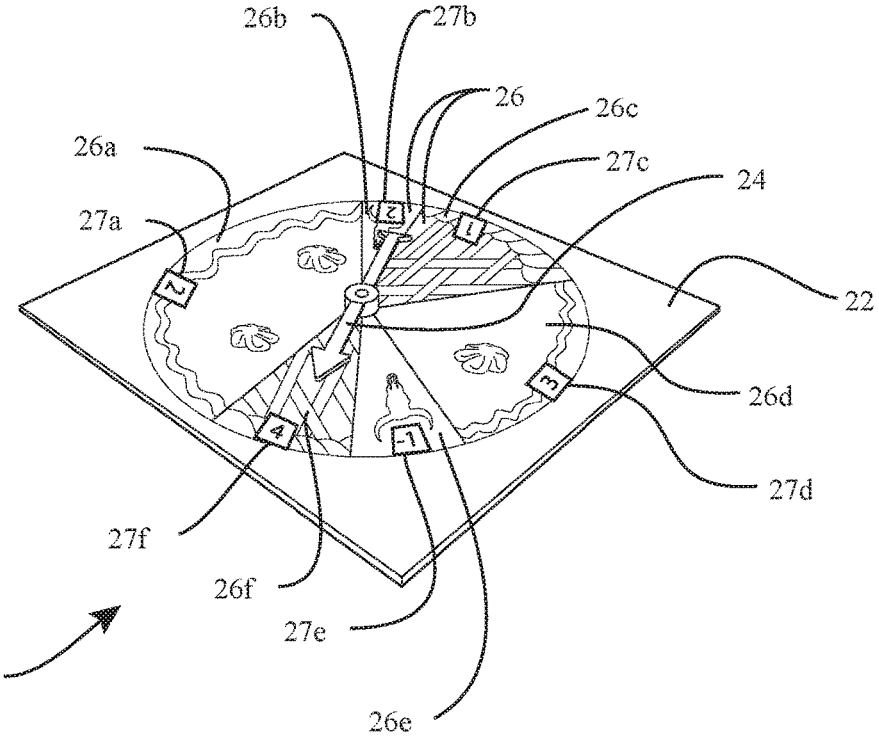

PIE GAME AND METHOD FOR PLAYING THE SAME

CROSS-REFERENCE TO RELATED APPLICATIONS

This patent application claims priority to, and incorporates by reference in its entirety, U.S. Provisional Patent Application No. 62/204,398, entitled "Pie Game And Method For Playing The Same", filed on Aug. 12, 2015.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a pie game and a method for playing the same. More particularly, the invention relates to a pie game involving chance and strategy and a method for playing the pie game.

2. Background

Board games and other types of tabletop games are often played by a group of players for enjoyment and relaxation. However, many games on the market today tend to be overly complex, with a set of complicated rules that take an extensive amount of time for players to learn. The complexity and time required to become familiar with such games significantly reduces the enjoyment that many people experience when playing these games.

Therefore, what is needed is a game that is capable of being readily played and enjoyed with family and friends. Moreover, a game is needed that is capable of being played without requiring the players of the game to learn an inordinate number of rules prior to the playing thereof. Furthermore, there is a need for a game that encourages families and friends to interact, talk, and strategize during the playing of the game.

BRIEF SUMMARY OF EMBODIMENTS OF THE INVENTION

Accordingly, the present invention is directed to a pie game and a method for playing the same that substantially obviates one or more problems resulting from the limitations and deficiencies of the related art.

In accordance with one or more embodiments of the present invention, there is provided a pie game of chance and strategy. The pie game includes a plurality of sector-shaped game pieces, a first subset of the plurality of sector-shaped game pieces comprising favorable pie indicia printed thereon, and a second subset of the plurality of sector-shaped game pieces comprising unfavorable pie indicia printed thereon; a plurality of pans configured to be distributed to players of the pie game, each of the plurality of pans configured to hold a portion of the plurality of sector-shaped game pieces therein such that, when the pan is circumferentially filled with the portion of the plurality of sector-shaped game pieces, a complete circular pie is formed in the pan; and at least one die, the at least one die configured to determine an action taken by one or more of the players of the pie game when the at least one die is rolled by one of the players. When a particular player or team of the players completely fills one of the plurality of pans with a collection of the plurality of sector-shaped game pieces having the same type of favorable pie indicia printed thereon, the particular player or the team of players is declared the winner of the pie game.

In a further embodiment of the present invention, the pie game further comprises a spinner device, the spinner device including a base portion with a plurality of sectorial indicia printed thereon, at least one of the plurality of sectorial indicia on the base portion indicating a quantity and type of the plurality of sector-shaped game pieces to be taken by one or more players of the pie game, and the spinner device further including a spinner arrow rotatably coupled to the base portion, the spinner arrow configured to point at one of the plurality of sectorial indicia on the base portion when the spinner arrow is spun by one of the players of the pie game.

In yet a further embodiment, the first subset of the plurality of sector-shaped game pieces with the favorable pie indicia printed thereon comprises a plurality of sector-shaped game pieces with different varieties of pie printed thereon, and wherein the second subset of the plurality of sector-shaped game pieces with the unfavorable pie indicia printed thereon comprises a plurality of sector-shaped game pieces with dry pieces of pie printed thereon.

In still a further embodiment, the plurality of sector-shaped game pieces further comprises a plurality of action cards, each of the plurality of action cards having indicia designating a particular action printed thereon.

In yet a further embodiment, the particular actions printed on respective ones of the plurality of action cards comprise one or more of the following actions: (i) passing the pans of the players to the right, (ii) replacing one or more sector-shaped game pieces comprising the unfavorable pie indicia with one or more corresponding sector-shaped game pieces comprising the favorable pie indicia, (iii) switching one or more sector-shaped game pieces comprising the favorable or the unfavorable pie indicia printed thereon with another player, (iv) distributing one or more sector-shaped game pieces comprising the unfavorable pie indicia printed thereon to all the players except the one holding the action card, (v) preventing the player holding the action card from receiving the sector-shaped game pieces comprising the unfavorable pie indicia, (vi) distributing one or more sector-shaped game pieces comprising the unfavorable pie indicia printed thereon to the player holding the action card, (vii) discarding one or more sector-shaped game pieces comprising the favorable and/or the unfavorable pie indicia printed thereon into a discard pile, and (viii) taking one or more sector-shaped game pieces comprising the favorable pie indicia printed thereon from another player.

In still a further embodiment, the at least one die comprises a plurality of sides, each of the plurality of sides of the at least one die having respective indicia printed thereon designating a particular action to be taken by the one or more of players when the at least one die is rolled by the one of the players.

In yet a further embodiment, the at least one die comprises a plurality of sides, each of the plurality of sides of the at least one die having a respective quantity of dots or numeric indicia printed thereon.

In accordance with one or more other embodiments of the present invention, there is provided a method for playing a pie game of chance and strategy. The method comprises the steps of: (1) providing a pie game that includes a plurality of sector-shaped game pieces, a first subset of the plurality of sector-shaped game pieces comprising favorable pie indicia printed thereon, and a second subset of the plurality of sector-shaped game pieces comprising unfavorable pie indicia printed thereon; a plurality of pans configured to be distributed to players of the pie game, each of the plurality of pans configured to hold a portion of the plurality of sector-shaped game pieces therein such that, when the pan is circumferentially filled with the portion of the plurality of sector-shaped game pieces, a complete circular pie is formed in the pan; and at least one die, the at least one die configured to determine an action taken by one or more of the players of the pie game when the at least one die is rolled by one of the players; (2) distributing one of the plurality of pans to each of the players; (3) rolling the at least one die to determine an action taken by one or more of the players, and based upon the rolling of the at least one die, carrying out the action by performing one or more of the following: (i) distributing one or more sector-shaped game pieces comprising the favorable pie indicia or action card indicia printed thereon to one or more of the players, (ii) distributing one or more sector-shaped game pieces comprising the unfavorable pie indicia printed thereon to one or more of the players, (iii) replacing one pan of the plurality of pans held by one of the players with another pan of the plurality of pans held by another of the players, (iv) allowing one of the players to take one of the sector-shaped game pieces comprising the favorable pie indicia printed thereon from another of the players, and (v) distributing one or more sector-shaped game pieces comprising the favorable pie indicia or action card indicia printed thereon to one or more of the players and having the one or more of the players roll again; and (4) upon one or more of the players completely filling one or more pans held by the one or more of the players with a collection of the plurality of sector-shaped game pieces having the same type of favorable pie indicia printed thereon, declaring the one or more players to be the winner or winners of the pie game.

In a further embodiment of the present invention, the step of distributing one of the plurality of pans to each of the players further comprises additionally distributing one or more sector-shaped game pieces comprising the unfavorable pie indicia printed thereon to each of the players.

In yet a further embodiment, the method further comprises the steps of: (5) providing a spinner device, the spinner device including a base portion with a plurality of sectorial indicia printed thereon, at least one of the plurality of sectorial indicia on the base portion indicating a quantity and type of the plurality of sector-shaped game pieces to be taken by one or more players of the pie game, and the spinner device further including a spinner arrow rotatably coupled to the base portion, the spinner arrow configured to point at one of the plurality of sectorial indicia on the base portion when the spinner arrow is spun by one of the players of the pie game; and (6) instructing each of the players to take a turn on the spinner device so as to determine a quantity and type of the plurality of sector-shaped game pieces to be taken by each of the players of the pie game.

In still a further embodiment, the first subset of the plurality of sector-shaped game pieces with the favorable pie indicia printed thereon comprises a plurality of sector-shaped game pieces with different varieties of pie printed thereon, and wherein the second subset of the plurality of sector-shaped game pieces with the unfavorable pie indicia printed thereon comprises a plurality of sector-shaped game pieces with dry pieces of pie printed thereon.

In yet a further embodiment, the plurality of sector-shaped game pieces further comprises a plurality of action cards, each of the plurality of action cards having indicia designating a particular action printed thereon; and the method further comprises the steps of: (5) arranging a remaining portion of the plurality of sector-shaped game pieces comprising unfavorable pie indicia printed thereon in a first pile on the playing surface; and (6) arranging a remaining portion of the plurality of sector-shaped game pieces comprising favorable pie indicia printed thereon in a second pile on the playing surface together with the plurality of action cards.

In still a further embodiment, the particular actions printed on respective ones of the plurality of action cards comprise one or more of the following actions: (i) passing the pans of the players to the right, (ii) replacing one or more sector-shaped game pieces comprising the unfavorable pie indicia with one or more corresponding sector-shaped game pieces comprising the favorable pie indicia, (iii) switching one or more sector-shaped game pieces comprising the favorable or the unfavorable pie indicia printed thereon with another player, (iv) distributing one or more sector-shaped game pieces comprising the unfavorable pie indicia printed thereon to all the players except the one holding the action card, (v) preventing the player holding the action card from receiving the sector-shaped game pieces comprising the unfavorable pie indicia, (vi) distributing one or more sector-shaped game pieces comprising the unfavorable pie indicia printed thereon to the player holding the action card, (vii) discarding one or more sector-shaped game pieces comprising the favorable and/or the unfavorable pie indicia printed thereon into a discard pile, and (viii) taking one or more sector-shaped game pieces comprising the favorable pie indicia printed thereon from another player.

In yet a further embodiment, the method further comprises the steps of: (5) determining whether or not one or more pans held by one or more of the players is completely filled by a collection of the plurality of sector-shaped game pieces having unfavorable pie indicia printed thereon; and (6) when it is determined that the one or more pans held by the one or more of the players is completely filled by the collection of the plurality of sector-shaped game pieces having unfavorable pie indicia printed thereon, eliminating the one or more of the players having the one or more pans completely filled by the collection of the plurality of sector-shaped game pieces having unfavorable pie indicia printed thereon from the pie game.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which:

FIG. 2 is another top perspective view of the pie game box of FIG. 1, wherein the lid is shown removed from the box;

FIG. 3 is a top perspective view of a spinner device of the pie game, according to an embodiment of the invention;

Throughout the figures, the same parts are always denoted using the same reference characters so that, as a general rule, they will only be described once.

DETAILED DESCRIPTION OF EMBODIMENTS OF THE INVENTION

Figure 1:
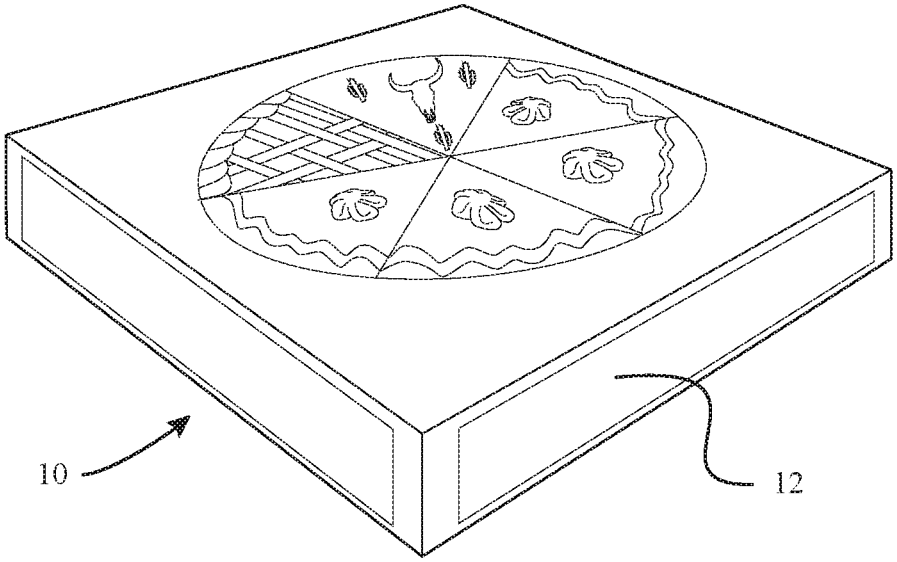
FIG. 1 is a top perspective view of a box housing a pie game, according to an embodiment of the invention, wherein a lid is disposed on the box.

An illustrative embodiment of a pie game is depicted in FIGS. 3-14 herein. Initially, with reference to FIGS. 6-11 and 14, it can be seen that the pie game generally comprises a plurality of sector-shaped game pieces 35, 36, 37, 39, 40, a first subset of the plurality of sector-shaped game pieces comprising favorable pie indicia printed thereon 35, 36, 37, and a second subset of the plurality of sector-shaped game pieces comprising unfavorable pie indicia printed thereon 39; a plurality of pans 30 configured to be distributed to players of the pie game, each of the plurality of pans 30 configured to hold a portion of the plurality of sector-shaped game pieces therein (refer to FIGS. 9 and 10) such that, when the pan 30 is circumferentially filled with the portion of the plurality of sector-shaped game pieces 36, a complete circular pie is formed in the pan (see FIG. 10); and at least one die 44, 66 (refer to FIGS. 8 and 14), the at least one die 44, 66 configured to determine an action taken by one or more of the players of the pie game when the at least one die 44, 66 is rolled by one of the players. In the illustrated embodiment, when a particular player or team of the players completely fills one of the plurality of pans 30 with a collection of the plurality of sector-shaped game pieces having the same type of favorable pie indicia printed thereon 36 (see FIG. 10), the particular player or the team of players is declared the winner of the pie game. In one or more embodiments, the pie game involves both chance and strategy. The pie game involves chance because the at least one die 44, 64, 66 randomly determines the outcome of a particular player or players turn. The pie game also involves strategy because, when the pie game is being played with teams, players on the same team can strategize with one another to determine the fastest and easiest manner in which to win the game. For example, if one member of a team has more good pie pieces of the same type (e.g., slices of cherry pie) in his or her pan 30 as compared to the other player on the same team, the strategy of the team members may be to focus on completely filling that player's pie pan 30 because he or she is closer to winning the game. As another example of a game strategy, suppose one member of the opposing team has more unfavorable pie pieces (e.g., slices of Grandma's dry pie) than the other player on the team, the strategy of the opposing team may be to direct all unfavorable pie pieces (e.g., slices of Grandma's dry pie) to that member of the team in an attempt to eliminate that team member from the game (i.e., because they are closer to being eliminated than the other team member).

Figure 6:
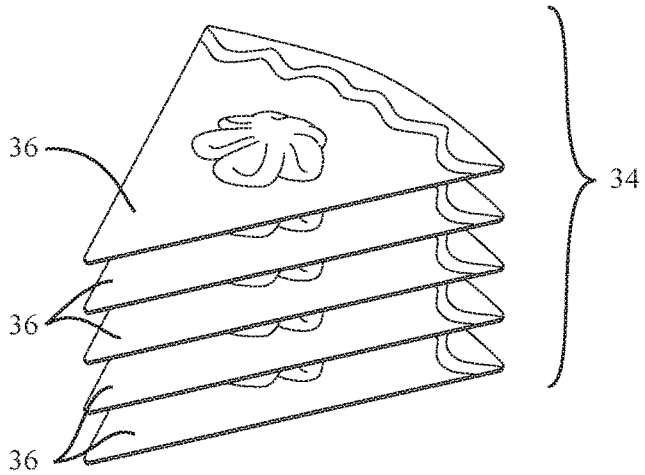
FIG. 6 is a perspective view of a first type of sector-shaped game pieces of the pie game comprising favorable pie indicia printed thereon, according to an embodiment of the invention.
Figure 9:
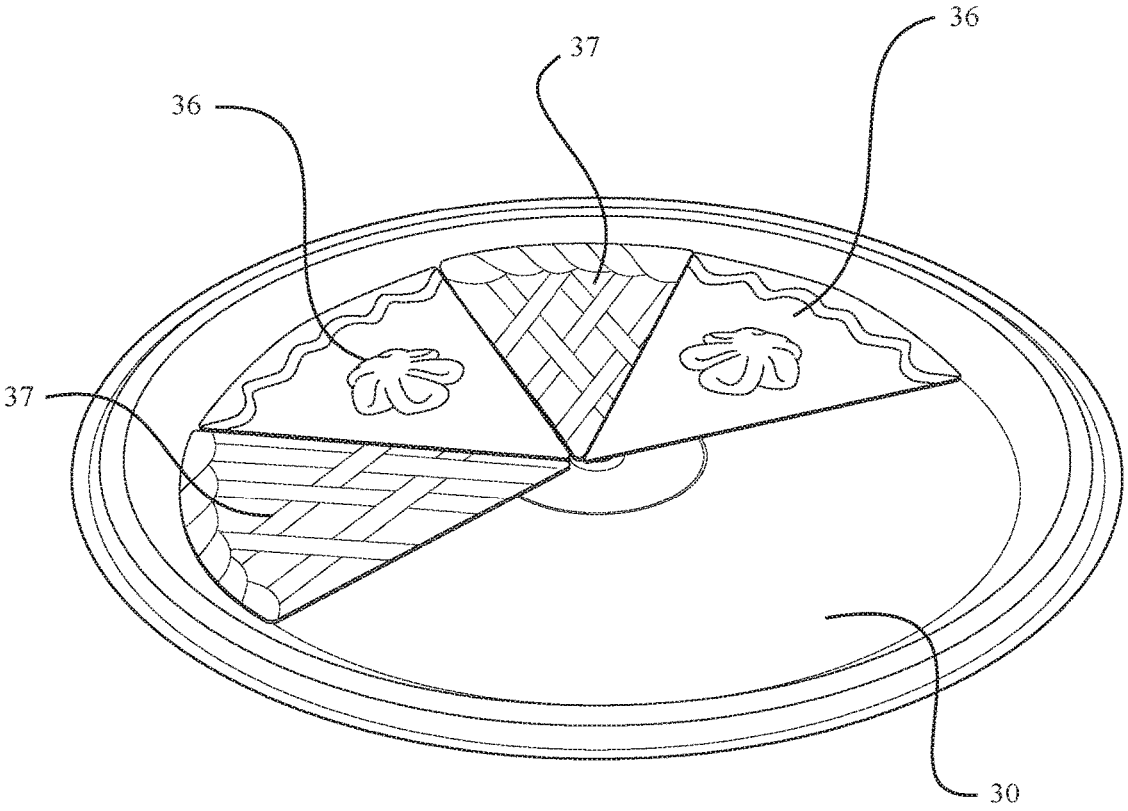
FIG. 9 is a perspective view of a partially filled pie pan of the pie game, according to an embodiment of the invention, wherein sector-shaped game pieces comprising different types of favorable pie indicia printed thereon are shown in the pie pan.
Figure 10:
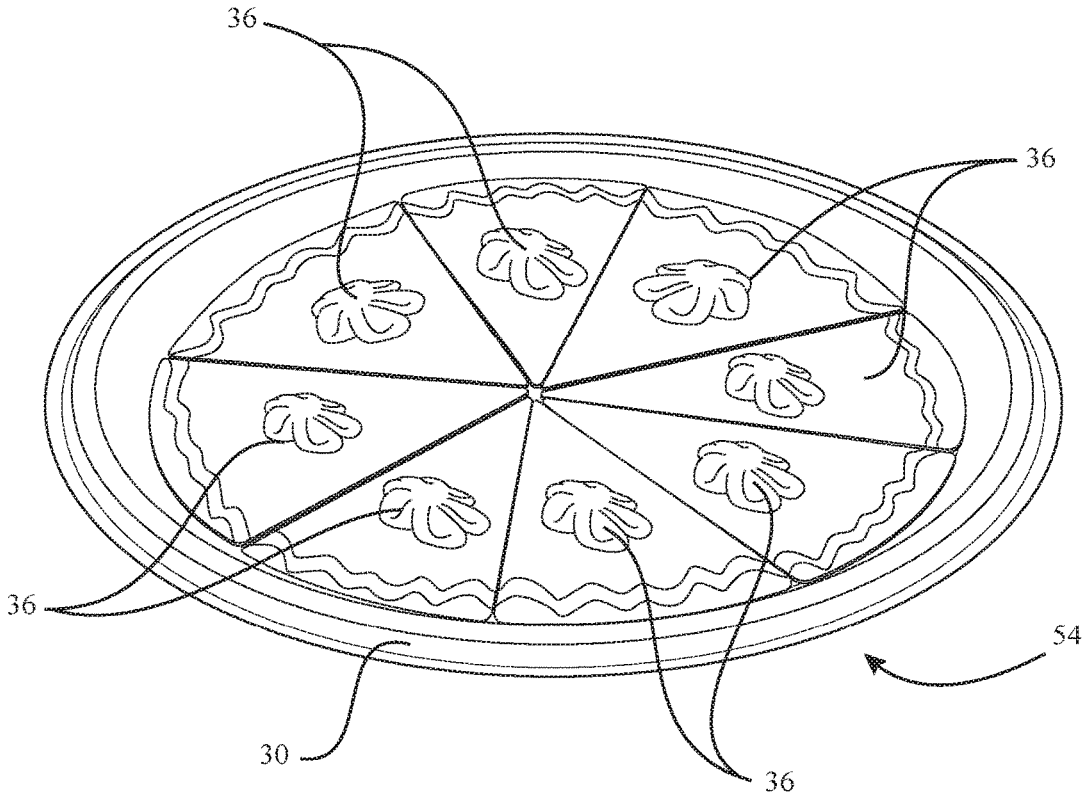
FIG. 10 is a perspective view of a completely filled pie pan of the pie game, according to an embodiment of the invention, wherein sector-shaped game pieces comprising the same type of favorable pie indicia printed thereon are shown in the pie pan.

In the illustrative embodiment, the first subset of the plurality of sector-shaped game pieces with the favorable pie indicia printed thereon comprises a plurality of sector-shaped game pieces with different varieties of pie printed thereon 35, 36, 37 (refer to FIGS. 6 and 9-11). For example, as depicted in FIG. 6, the first set 34 of favorable game pieces may comprise a plurality of pie pieces 36 with pumpkin pie indicia inscribed thereon (i.e., slices of pumpkin pie). FIG. 9 illustrates a partially filled pie pan 30 with two different varieties of favorable game pieces disposed therein, namely pie pieces 36 with pumpkin pie indicia inscribed thereon and pie pieces 37 with cherry pie indicia inscribed thereon. FIG. 9 is representative of a pie pan 30 in progress during the course of playing the pie game described herein (i.e., before the player holding the pie pan 30 has filled the pie pan 30 with favorable game pieces of all the same type of pie). In contrast, FIG. 10 illustrates a completely filled pie pan 54, wherein the pan 30 has been filled with all of the same type of pie, namely pumpkin pie slices 36. In accordance with the rules of the game, the player holding the completely filled pie pan 54 of FIG. 10 would be declared the winner of the game. The exemplary set 56 of game pieces in FIG. 11 comprises two different varieties of favorable game pieces (e.g., a slightly different pumpkin pie slice 35 and a slice of cherry pie 37) together with an unfavorable game piece (e.g., a slice of Grandma's dry pie 39), as will be described in more detail hereinafter.

Figure 11:
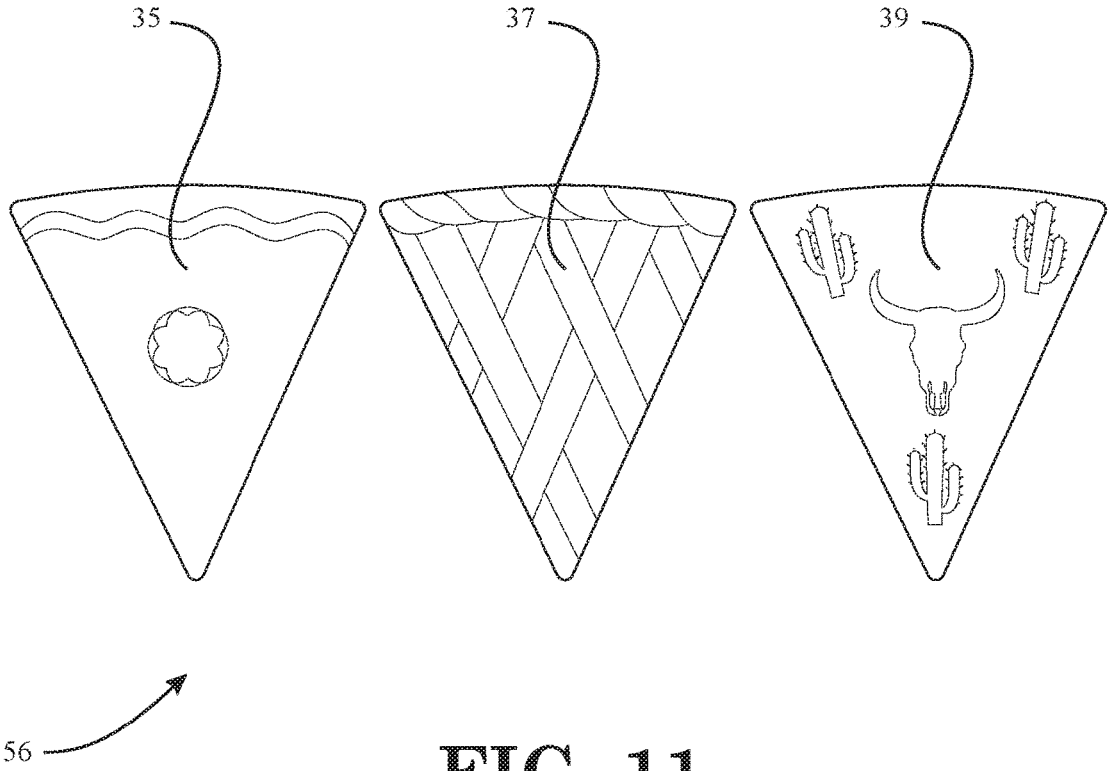
FIG. 11 is a top view illustrating two different types of sector-shaped game pieces comprising favorable pie indicia printed thereon together with a sector-shaped game piece comprising unfavorable pie indicia printed thereon, according to an embodiment of the invention.

With reference to FIG. 11, in the illustrative embodiment, the second subset of the plurality of sector-shaped game pieces with the unfavorable pie indicia printed thereon comprises a plurality of sector-shaped game pieces with dry pieces of pie printed thereon 39 (i.e., slices of Grandma's dry pie). During the course of playing the pie game described herein, a player tries to minimize the number of slices of Grandma's dry pie 39 that are obtained because, as will be explained in more detail below, completely filling one's pie pan 30 with slices of Grandma's dry pie 39 results in the player's elimination from the game. As such, while playing the game, when a player has one or more slices of Grandma's dry pie 39 in his or her pan 30, it is in the player's best interest to exchange the one or more slices of Grandma's dry pie 39 with slices of good pie 35, 36, 37, if given the opportunity to do so.

Figure 7:
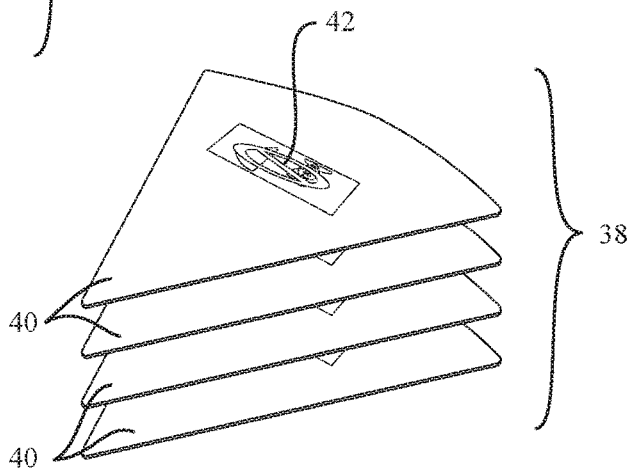
FIG. 7 is a perspective view of a plurality of action cards of the pie came, according to an embodiment of the invention.
Figure 12:
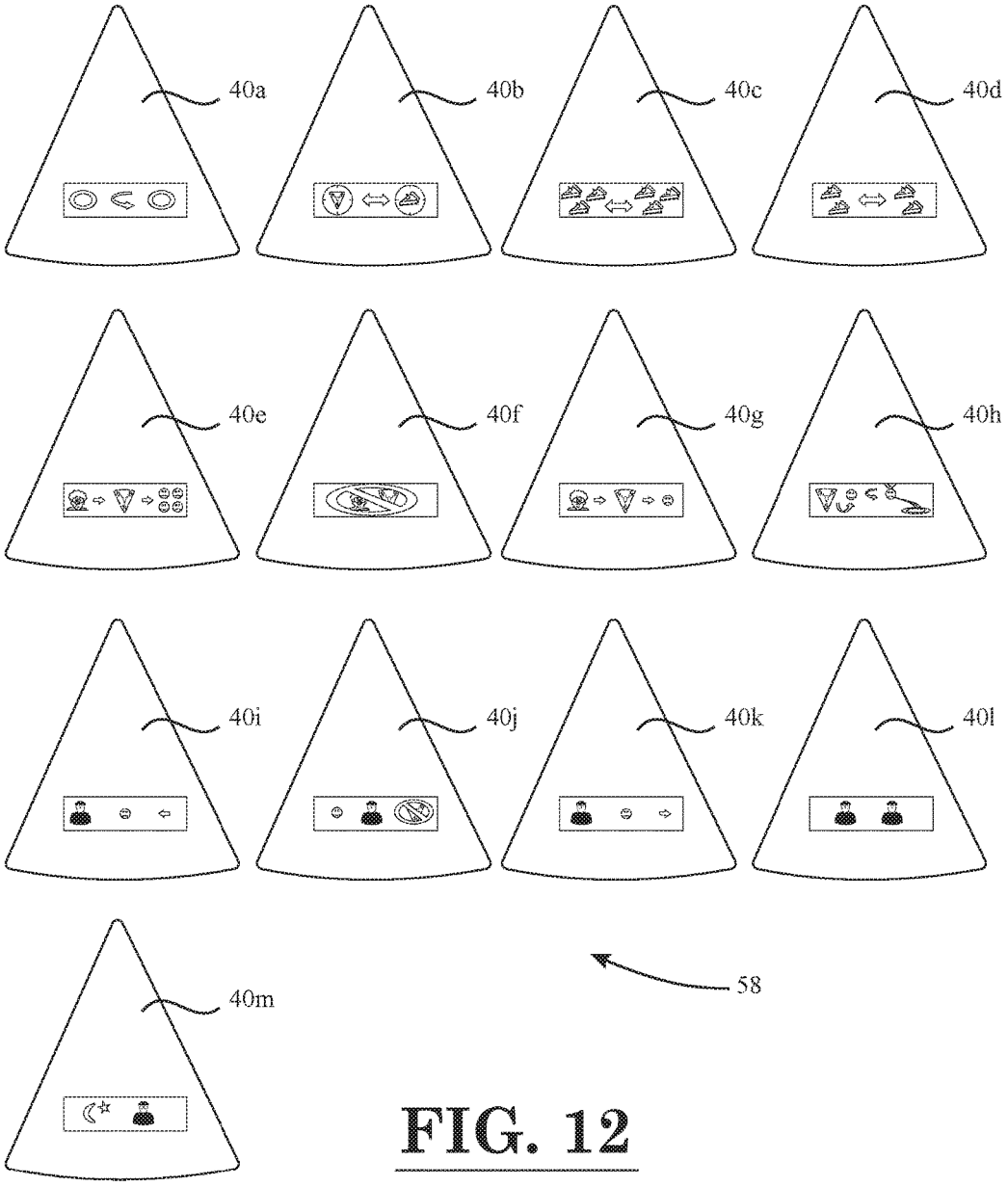
FIG. 12 is a top view illustrating different types of the plurality of action cards of the pie game, according to an embodiment of the invention.

Referring to FIGS. 7 and 12, it can be seen that, in the illustrative embodiment, the plurality of sector-shaped game pieces of the pie game further comprises a plurality of action cards 40, 58. As shown in FIG. 7, each of the plurality of action cards 40 has indicia 42 designating a particular action printed thereon (i.e., an action card image 42 inscribed thereon). A set 38 of action cards 40 is depicted in FIG. 7. In FIG. 12, an exemplary set 58 of action cards 40 with different action indicia inscribed thereon are shown. As illustrated in this figure, the particular actions printed on respective ones of the plurality of action cards 40 comprise one or more of the following actions: (i) passing the pans of each player to the right (e.g., action card 40*a* in FIG. 12); (ii) replacing one or more sector-shaped game pieces comprising the unfavorable pie indicia with one or more corresponding sector-shaped game pieces comprising favorable pie indicia (e.g., action card 40*b* in FIG. 12, which allows a player to replace all slices of Grandma's dry pie 39 in his or her pan 30 with new favorable pie slices 35, 36, 37 that may be picked from other players in the game, the replaced slices of Grandma's dry pie 39 are placed in the discard pile); (iii) switching one or more sector-shaped game pieces comprising favorable or unfavorable pie indicia printed thereon with another player (e.g., action cards 40*d*, 40*c* in FIG. 12, which require a player to switch two and three pieces of pie with another player, respectively, but do not allow like cards to be switched); (iv) distributing one or more sector-shaped game pieces comprising unfavorable pie indicia printed thereon to all players except the one that drew the action card and any player holding a "no dry pie" action card 40*f* (e.g., action card 40*e* in FIG. 12, which requires Grandma's dry pie 39 to be served to all players except the one that drew the action card and any player holding a "no dry pie" action card 40*f*, if any player's pie pan 30 is full, he or she must replace good pie pieces with dry); (v) preventing a player holding the action card from receiving the sector-shaped game pieces comprising unfavorable pie indicia (e.g., action card 40*f* in FIG. 12, which is the "No Grandma's Dry Pie Card" that can be held until someone attempts to give the player a slice of Grandma's dry pie 39, the card is used to refuse Grandma's dry pie, and must be discarded after use, but it stays with any "switched pan"); (vi) distributing one or more sector-shaped game pieces comprising unfavorable pie indicia printed thereon to the player holding the action card (e.g., action card 40*g* in FIG. 12, which requires a slice of Grandma's dry pie 39 to be served to the player holding the card, if the player's pan is full, he or she must replace good pie pieces with dry); (vii) discarding one or more sector-shaped game pieces comprising favorable and/or unfavorable pie indicia printed thereon into a discard pile (e.g., action card 40*h* in FIG. 12, which requires all of a player's pieces to be placed in the discard pile, action card 40*h* symbolically illustrates Grandpa eating too many slices of Grandma's dry pie 39 and getting sick in the player's pan 30, which necessitates the pan 30 to be cleaned out and pie pieces disposed therein to be discarded; and (viii) taking one or more sector-shaped game pieces comprising favorable pie indicia printed thereon from another player (e.g., action card 40*i*-40*m* in FIG. 12, which will be described in more detail hereinafter). Action card 40*i* allows a player to optionally take (steal) a slice of pie from the person to his or her left. If the player chooses to take a slice of pie from the person to his or her left, then an existing piece of pie in his or her pan is placed in the discard pile if his or her pan is full because the existing piece of pie is being replaced by the stolen piece. If his or her pan is not full, then no cards are required to be discarded. Action card 40*j* requires a player to discard a slice of his or her good pie to the discard pile (i.e., action card 40*j* symbolically represents Grandpa taking a piece of the player's pie, but because Grandpa does not eat Grandma's dry pie, the player is required to pick a piece of his or her good pie, and place it in the discard pile. Action card 40*k* allows a player to optionally take (steal) a slice of pie from the person to his or her right. If the player chooses to take a slice of pie from the person to his or her right, then an existing piece of pie in his or her pan is placed in the discard pile if his or her pan is full because the existing piece of pie is being replaced by the stolen piece. If his or her pan is not full, then no cards are required to be discarded. Action card 40*l* allows a player to optionally take (steal) two slices of pie. If the player chooses to take the two slices of pie, the slices of pie may be taken from multiple other players of the game, and existing pieces of pie in his or her pan are placed in the discard pile if his or her pan is full because the existing pieces of pie are being replaced by the stolen pieces. If his or her pan is not full, then no cards are required to be discarded. Action card 40*m* allows a player to optionally take (steal) a slice of pie from anyone (i.e., action card 40*m* symbolically represents it being midnight and that the player is allowed to take a piece of pie from the refrigerator). If the player chooses to take a slice of pie from any other player, then an existing piece of pie in his or her pan is placed in the discard pile if his or her pan is full because the existing piece of pie is being replaced by the stolen piece. If his or her pan is not full, then no cards are required to be discarded.

Figure 4:
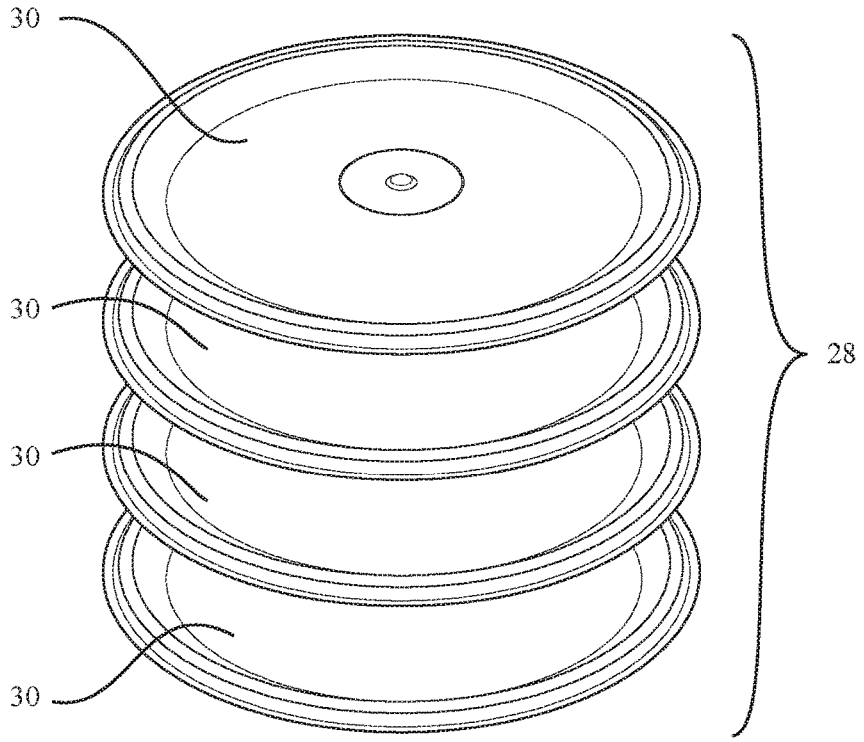
FIG. 4 is a perspective view of a set of game pie pans of the pie game, according to an embodiment of the invention.

Turning to FIG. 4, it can be seen that a set 28 of pie pans 30 for the pie game are illustrated therein. Similar to the pie pans used for baking a pie, each of the pie pans 30 depicted in FIG. 4 comprise a circular body portion with an upturned peripheral rim for retaining the pie pieces in the pie pan 30. While a total of four (4) pie pans 30 are illustrated in FIG. 4, it is to be understood that more or fewer pie pans 30 may be provided in conjunction with the pie game described herein so as to accommodate the desired number of players who wish to play the game.

Figure 8:
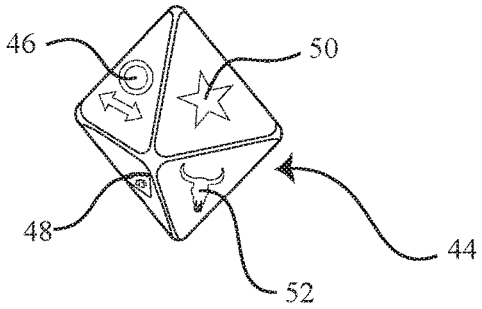
FIG. 8 is a perspective view of a first type of dice of the pie game, according to an embodiment of the invention, wherein the die contains a plurality of sides with respective indicia printed thereon designating a particular action.

Next, with reference to FIG. 8, the first type of die or dice 44 that may be used in conjunction with the pie game will be described. As shown in this figure, the first type of die or dice 44 comprises polyhedral-type dice with a plurality of sides (e.g., an eight-sided dice). Each of the plurality of sides of the die or dice 44 has respective indicia 46, 48, 50, 52 printed thereon designating a particular action to be taken by one or more of players when the die or dice 44 is rolled by one of the players. For example, in the illustrated embodiment of FIG. 8, the first instructional image 46 on the first side of the die or dice 44 requires a player to switch his or her pie pan 30 with any one of the other players in the game. The second instructional image 48 on the second side of the die or dice 44 requires a player to pick a particular pie card (e.g., a slice of cherry pie) or action card from the good pie piece/action card pile. The third instructional image 50 on the third side of the die or dice 44 requires a player to pick a pie card or action card from the good pie piece/action card pile, and to roll again. The fourth instructional image 52 on the fourth side of the die or dice 44 requires a player to pick a slice of Grandma's dry pie 39. The other sides of the die or dice 44, which are not visible in FIG. 8, may have another instructional image that allows a player to optionally take (steal) a slice of pie from another player.

As depicted in FIG. 3, in the illustrative embodiment, the pie game may further comprise a spinner device 20, which is used in the initial setup of the game. As shown in this figure, the spinner device 20 includes a spinner base portion 22 with a plurality of sectorial indicia 26*a*, 26*b*, 26*c*, 26*d*, 26*e*, 26*f* printed thereon. As will be explained hereinafter, the plurality of sectorial indicia 26*a*, 26*b*, 26*c*, 26*d*, 26*e*, 26*f* on the base portion 22 indicate a quantity and type of the plurality of sector-shaped game pieces to be taken by one or more players of the pie game. In FIG. 3, it can be seen that the image sectors 26 on the spinner may be of different sizes (i.e., different angular widths) so as to modify the odds of falling on a particular one of the image sectors as compared to one or more other ones of the image sectors 26. For example, in FIG. 3, the image sector with sectorial indicia 26*b* is much narrower than the image sector with sectorial indicia 26*a*, thereby making the odds of landing on the image sector with sectorial indicia 26*a* much greater than landing on the image sector with sectorial indicia 26*b*. In FIG. 3, it can be seen that each of the image sectors 26 comprises a number 27*a*, 27*b*, 27*c*, 27*d*, 27*e*, 27*f* printed thereon. Each of the numbers 27*a*, 27*b*, 27*c*, 27*d*, 27*e*, 27*f* determines the quantity of pie pieces that are to be distributed to a particular player of the pie game. For example, with reference to illustrative spinner device 20 of FIG. 3, the pie pieces are distributed in the following manner: (i) if a player lands on image sector 26*a*, he or she will receive two (2) pieces of pumpkin pie in accordance with the numeric indicia 27*a*, (ii) if a player lands on image sector 26*b*, he or she will receive two (2) pieces of Grandma's dry pie in accordance with the numeric indicia 27*b*, (iii) if a player lands on image sector 26*c*, he or she will receive one (1) piece of cherry pie in accordance with the numeric indicia 27*c*, (iv) if a player lands on image sector 26*d*, he or she will receive three (3) pieces of pumpkin pie in accordance with the numeric indicia 27*d*, (v) if a player lands on image sector 26*e*, his or her one (1) piece of Grandma's dry pie will be taken away, and (vi) if a player lands on image sector 26*f*, he or she will receive four (4) pieces of cherry pie in accordance with the numeric indicia 27*f*. As shown in FIG. 3, the spinner device 20 further includes a spinner arrow 24 rotatably coupled to the base portion 22. The spinner arrow 24 is configured to point at one of the plurality of sectorial indicia 26*a*, 26*b*, 26*c*, 26*d*, 26*e*, 26*f* on the base portion 22 when the spinner arrow 24 is spun by one of the players of the pie game.

Figure 14:
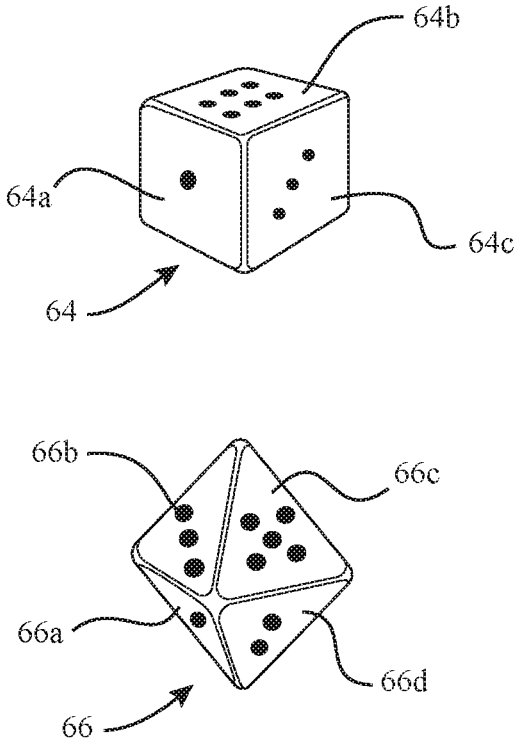
FIG. 14 is a perspective view of second and third types of dice of the pie game, according to an embodiment of the invention, wherein the first die in the upper portion of FIG. 14 is in the form of a cubic die, and the second die in the lower portion of FIG. 14 is in the form of a polyhedral die.

Referring to FIG. 14, additional types 64, 66 of dice that may be used in conjunction with the pie game will be described. As shown in the upper portion of FIG. 14, a cubic-style die 64 has a plurality of sides 64*a*, 64*b*, 64*c* with different quantities of dots printed thereon (i.e., a six-sided dice). Similarly, in the lower portion of FIG. 14, a polyhedral-style die 66 has a plurality of sides 66*a*, 66*b*, 66*c*, 66*d* with different quantities of dots printed thereon. In an alternative embodiment, numeric indicia (i.e., Arabic numbers) may be printed on the sides of the dice, rather than different quantities of dots. In one or more embodiments, the dice 64 may be used as an alternative to the spinner device 20 described above. For example, in these one or more embodiments, the different quantities of dots on the different sides 64*a*, 64*b*, 64*c* of the dice 64 may correspond to a particular action to be taken by the player rolling the dice 64 (e.g., rolling "one" may correspond to taking one slice of cherry or pumpkin pie, rolling "two" may correspond to taking two slices of cherry or pumpkin pie, rolling "three" may correspond to taking three slices of cherry or pumpkin pie, rolling "four" may correspond to taking four slices of cherry or pumpkin pie, rolling "five" may correspond to discarding a slice of dry pie, and rolling "six" may correspond to receiving an additional piece of dry pie. After each player takes a turn with the six-sided dice 64 to determine the quantity and type of pie pieces that he or she receives, the player places the pie pieces received in his or her pie pan 30. After each of the players takes a turn with the six-sided dice 64, the six-sided dice 64 is stowed away until the next game.

Figure 5:
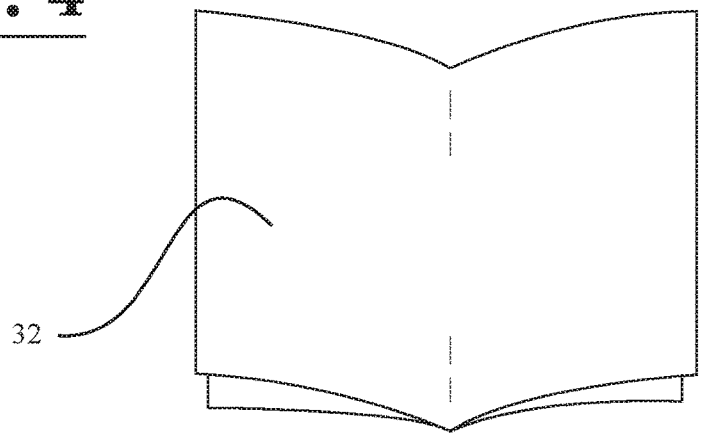
FIG. 5 is a perspective view of a game instructional manual of the pie game, according to an embodiment of the invention.

Turning to FIG. 5, it can be seen that the illustrative embodiment of the pie game may also comprise a game instructional manual 32. The game instructional manual 32 may include, inter alia, the rules for playing the pie game. The procedural rules for playing the pie game will be described in more detail hereinafter.

As shown in FIGS. 1 and 2, the illustrative embodiment of the pie game may additionally include a box 10 for holding the various components 20, 30, 32, 35, 36, 37, 39, 40, 44, 64, 66 of the pie game. As shown in FIG. 2, the pie game box 10 may include a bottom portion 14 with upwardly extending sidewalls and a top portion 12 with downwardly extending sidewalls that overlap the upwardly extending sidewalls of the bottom portion 14 when the box 10 is closed (as in FIG. 1). In FIG. 1, it can be seen that the top portion 12 of the box 10 may include an image 16 printed on the top wall or panel thereof (i.e., an image of a pie formed by slices of pie of different types). Also, as depicted in FIGS. 1 and 2, the downwardly extending sidewalls of the top portion 12 may include instructional information printed thereon, such as the procedural rules for playing the pie game. Also, in the illustrative embodiment, the meanings of the action cards 40 may be provided on the back side of the box 10 (i.e., the meanings of the action cards 40*a*-40*m* in FIG. 12).

Figure 13:
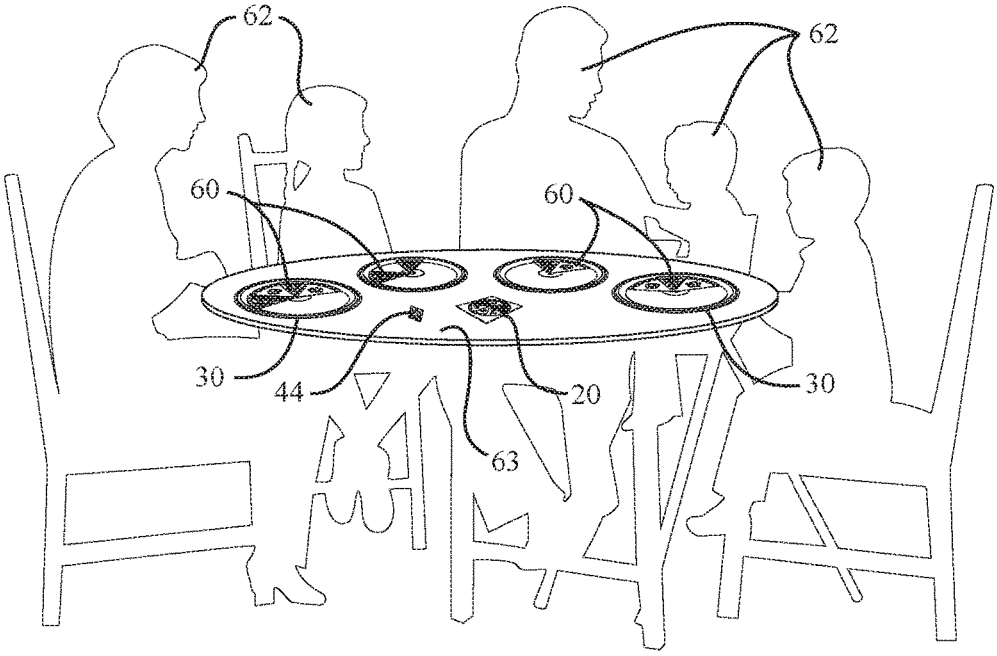
FIG. 13 is a perspective view of players seated at a table and playing the pie game described herein, according to an embodiment of the invention.

FIG. 13 illustrates a plurality of players 62 sitting at a table 63, and playing the pie game described herein. As shown in this figure, one exemplary pie game setup includes the spinner device 20, the die 44, and a plurality of pie pans 30 disposed on the table 63. The pie game depicted in FIG. 13 is in progress, so a plurality of partially filled pie pans 60 are illustrated in FIG. 13.

Now, referring primarily to FIGS. 3, 8-10, 12, and 13, an illustrative method and rule set for playing the pie game, which utilizes the game components described above, will be described in detail. First of all, the initial setup of the pie game will be described. At the beginning of the pie game, each player 62 gets a pie pan 30 and a slice of Grandma's dry pie 39. Then, each player 62 takes a turn on the spinner 20 to determine the additional pie pieces that they will receive to start the game. The youngest player of the game takes the first turn on the spinner 20. After each player 62 spins the arrow 24 on the spinner 20 to determine the quantity and type of pie pieces that he or she receives (see FIG. 3), the player places the pie pieces received in his or her pie pan 30. After each of the players 62 takes one spin, the spinner 20 is stowed away until the next game. As described above, the dice 64 may be used in lieu of the spinner device 20, if desired. During the final part of the initial game setup, the remaining cards are placed in the middle of the table 63. The Grandma's dry pie cards 39 are arranged in a first pile on the table 63, and the remaining cards (i.e., both good slices of pie 35, 36, 37 and action cards 40) are shuffled and placed in a second pile on the table 63.

Following the initial game setup, if each player 62 of the pie game is going to be playing alone (i.e., as individual players), the player 62 with the most cards 35, 36, 37, 39 in his or her pie pan 30 takes the first turn by rolling the die or dice 44, and performing the action that is indicated on the side of the die 44 that is rolled. The various actions that may be required by the die or dice 44 are described above. If two or more players of the pie game have the same number of cards 35, 36, 37, 39 in their pans 30, then the youngest player of the game wins the tie, and takes the first turn at rolling the dice. In an exemplary embodiment, the action of the game is carried out in a clockwise direction around the table 63.

The action of the pie game continues by players 62 taking turns at rolling the die or dice 44, and performing the required actions, until a player 62 is eliminated from the game or a player 62 is declared the winner of the game. If any player 62 completely fills his or her pie pan 30 with slices of Grandma's dry pie 39 (e.g., six (6) or eight (8) pieces of Grandma's dry pie 39 filling the pan 30), then that player 62 is out of the game. Conversely, when any player 62 completely fills his or her pie pan 30 with slices of the same type of good pie 35, 36, 37 (e.g., six (6) or eight (8) pieces of all cherry pie or all pumpkin pie filling the pan 30), then they are declared the winner, and the game is over.

Following the initial game setup described above, if the players 62 of the pie game are going to play the game using teams, rather than individually, the team with the most combined cards 35, 36, 37, 39 (i.e., based upon the overall sum of cards in the pans 30 of all respective team members) takes the first turn by rolling the die or dice 44, and performing the action that is indicated on the side of the die 44 that is rolled. The various actions that may be required by the die or dice 44 are described above. If two or more teams playing the pie game have the same combined number of cards 35, 36, 37, 39 in their pans, then the youngest team of the game wins the tie, and takes the first turn at rolling the dice. In an exemplary embodiment, the action of the game is carried out in a clockwise direction around the table 63.

The action of the pie game continues by the teams of players 62 taking turns at rolling the die or dice 44, and performing the required actions, until a player 62 of a team is eliminated from the game or a player 62 of a team is declared the winner of the game. If a player 62 of any team completely fills his or her pie pan 30 with slices of Grandma's dry pie 39 (e.g., six (6) or eight (8) pieces of Grandma's dry pie 39 filling the pan 30), then that team is out of the game. If only one team remains in the game, then they win. Conversely, when a player 62 of any team completely fills his or her pie pan 30 with slices of the same type of good pie 35, 36, 37 (e.g., six (6) or eight (8) pieces of all cherry pie or all pumpkin pie filling the pan 30), then the team with that player is declared the winner, and the game is over.

As such, in the illustrative embodiment, the pie game may be played individually (e.g., with 2-6 total players), or as teams. For some players, the pie game may be the most enjoyable when played in a team format (e.g., each player may select a partner). In the illustrative embodiment, even when the pie game is played in teams, every player 62 still gets a pie pan 30. When played using a team format, strategy discussions between teammates is encouraged.

In the illustrative embodiment, no player is permitted to overly fill his or pie pan 30 with games pieces (e.g., no more than six (6) or eight (8) pieces of pie may be in a pan 30 of a single player at a time). When the die 44 or an action card 40 denotes a "stealing" action, the player is not required to take or steal a card from another player (i.e., stealing is optional). In the instance where a player 62 already has a full pan 30 and is stealing cards from another player 62, then the player 62 who is stealing cards must place the extra cards in the "discard pile". Also, according to the rules of the pie game, when a player 62 already has a pan 30 full of good pie pieces (e.g., six (6) or eight (8) pieces of good pie pieces filling the pan), then that player 62 must replace one or more good pie pieces with one or more pieces of Grandma's dry pie 39 when he or she receives one or more pieces of Grandma's dry pie 39.

It is readily apparent that the aforedescribed pie game and the method for playing the same offer numerous advantages. First, the pie game described above is capable of being readily played and enjoyed with family and friends. Secondly, the pie game is capable of being played without requiring the players of the game to learn an inordinate number of rules prior to the playing thereof. Finally, the aforedescribed pie game encourages families and friends to interact, talk, and strategize during the playing of the game, so that they are able to create a complete pie (e.g., a complete cherry or pumpkin pie) and thereby win the game.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention. For example, while the varieties of pie in the illustrative embodiment are in the form of dessert pie, it is to be understood that the invention is not so limited. Rather, as one example, the claimed invention encompasses different varieties of pizza pie (i.e., cheese, pepperoni, sausage, etc.), as well as dessert pie. And, in general, the term "pie" as used herein includes both dessert pies and pizza pies, and other forms of pies as well (e.g., pot pies, etc.).

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A method for playing a pie game of chance and strategy, said method comprising the steps of:

providing a pie game that includes:

a plurality of sector-shaped game pieces, a first subset of said plurality of sector-shaped game pieces comprising favorable pie indicia printed thereon, and a second subset of said plurality of sector-shaped game pieces comprising unfavorable pie indicia printed thereon;

a plurality of pans configured to be distributed to players of said pie game, each of said plurality of pans configured to hold a portion of said plurality of sector-shaped game pieces therein such that, when said pan is circumferentially filled with said portion of said plurality of sector-shaped game pieces, a complete circular pie is formed in said pan, and each of said plurality of pans comprising a circular body portion with an upturned peripheral rim for retaining said sector-shaped game pieces in said pan;

a plurality of action cards, each of said plurality of action cards having indicia designating a particular action printed thereon, said particular actions printed on respective ones of said plurality of action cards comprising at least three of the following actions: (i) passing said pans of said players to the right, (ii) replacing one or more said sector-shaped game pieces comprising said unfavorable pie indicia with one or more corresponding said sector-shaped game pieces comprising said favorable pie indicia, (iii) switching one or more said sector-shaped game pieces comprising said favorable or said unfavorable pie indicia printed thereon with another said player, (iv) distributing one or more said sector-shaped game pieces comprising said unfavorable pie indicia printed thereon to all said players except the one holding said action card, (v) preventing said player holding said action card from receiving said sector-shaped game pieces comprising said unfavorable pie indicia, (vi) distributing one or more said sector-shaped game pieces comprising said unfavorable pie indicia printed thereon to said player holding said action card, (vii) discarding one or more said sector-shaped game pieces comprising said favorable and/or said unfavorable pie indicia printed thereon into a discard pile, and (viii) taking one or more said sector-shaped game pieces comprising said favorable pie indicia printed thereon from another said player; and at least one die, said at least one die configured to determine an action taken by one or more of said players of said pie game when said at least one die is rolled by one of said players;

distributing one of said plurality of pans to each of said players;

arranging a remaining portion of said plurality of sector-shaped game pieces comprising unfavorable pie indicia printed thereon in a first pile on a playing surface; arranging a remaining portion of said plurality of sector-shaped game pieces comprising favorable pie indicia printed thereon in a second pile on said playing surface together with said plurality of action cards;

rolling said at least one die to determine an action taken by one or more of said players, and based upon said rolling of said at least one die, carrying out said action by performing one or more of the following: (i) distributing one or more said sector-shaped game pieces comprising said favorable pie indicia printed thereon and/or distributing one or more said action cards to one or more of said players, (ii) distributing one or more said sector-shaped game pieces comprising said unfavorable pie indicia printed thereon to one or more of said players, (iii) replacing one pan of said plurality of pans held by one of said players with another pan of said plurality of pans held by another of said players, (iv) allowing one of said players to take one of said sector-shaped game pieces comprising said favorable pie indicia printed thereon from another of said players, and (v) distributing one or more said sector-shaped game pieces comprising said favorable pie indicia printed thereon and/or distributing one or more said action cards to one or more of said players and having said one or more of said players roll again; and upon one or more of said players completely filling one or more said pans held by said one or more of said players with a collection of said plurality of sector-shaped game pieces having the same type of favorable pie indicia printed thereon, declaring said one or more said players to be the winner or winners of said pie game.

2. The method according to claim 1, wherein the step of distributing one of said plurality of pans to each of said players further comprises additionally distributing one or more said sector-shaped game pieces comprising said unfavorable pie indicia printed thereon to each of said players.

3. The method according to claim 1, further comprising the steps of:

providing a spinner device, said spinner device including a base portion with a plurality of sectorial indicia printed thereon, at least one of said plurality of sectorial indicia on said base portion indicating a quantity and type of said plurality of sector-shaped game pieces to be taken by one or more players of said pie game, and said spinner device further including a spinner arrow rotatably coupled to said base portion, said spinner arrow configured to point at one of said plurality of sectorial indicia on said base portion when said spinner arrow is spun by one of said players of said pie game; and instructing each of said players to take a turn on said spinner device so as to determine a quantity and type of said plurality of sector-shaped game pieces to be taken by each of said players of said pie game.

4. The method according to claim 1, wherein said first subset of said plurality of sector-shaped game pieces with said favorable pie indicia printed thereon comprises a plurality of sector-shaped game pieces with different varieties of pie printed thereon, and wherein said second subset of said plurality of sector-shaped game pieces with said unfavorable pie indicia printed thereon comprises a plurality of sector-shaped game pieces with dry pieces of pie printed thereon.

5. The method according to claim 1, further comprising the steps of:

determining whether or not one or more said pans held by said one or more of said players is completely filled by a collection of said plurality of sector-shaped game pieces having unfavorable pie indicia printed thereon; and when it is determined that said one or more said pans held by said one or more of said players is completely filled by said collection of said plurality of sector-shaped game pieces having unfavorable pie indicia printed thereon, eliminating said one or more of said players having said one or more said pans completely filled by said collection of said plurality of sector-shaped game pieces having unfavorable pie indicia printed thereon from said pie game.

6. The method according to claim 1, wherein said at least one die comprises a plurality of sides, each of said plurality of sides of said at least one die having respective indicia printed thereon designating a particular action to be taken by said one or more of players when said at least one die is rolled by said one of said players.

7. The method according to claim 6, wherein said particular actions printed on said sides of said at least one die comprise one or more of the following actions: (i) requiring one of said players to switch his or her said pan with another of said players in said pie game, (ii) requiring one of said players to pick a particular one of said sector-shaped game pieces comprising favorable pie indicia or a particular one of said plurality of action cards from said second pile on said playing surface, (iii) requiring one of said players to draw one of said sector-shaped game pieces comprising favorable pie indicia or one of said plurality of action cards from said second pile on said playing surface, and to roll said at least one die again, and (iv) requiring one of said players to draw one of said sector-shaped game pieces comprising unfavorable pie indicia from said first pile on said playing surface.

8. The method according to claim 6, wherein said at least one die is in the form of a polyhedral-type dice with said plurality of sides.

* * * * *